US006065886A

United States Patent [19]

Embry et al.

[11] Patent Number: 6,065,886

[45] Date of Patent: May 23, 2000

[54] IMAGE FORMING APPARATUS WITH SHEET SEPARATOR

[75] Inventors: Kerry Leland Embry, Lexington; Scott Stephen Williams, Versailles, both of Ky.

[73] Assignee: Lexmark International, Inc., Lexington, Ky.

[21] Appl. No.: 09/302,882

[22] Filed: Apr. 30, 1999

[51] Int. Cl.[7] ..... B65H 3/52

[52] U.S. Cl. ..... 400/629; 400/630; 271/124; 271/167

[58] Field of Search ..... 400/627, 628, 400/629, 630, 632, 579; 271/121, 124, 137, 138, 167, 104

[56] References Cited

U.S. PATENT DOCUMENTS

| | | | |
|---|---|---|---|
| 5,277,417 | 1/1994 | Moritake et al. | 271/121 |
| 5,660,384 | 8/1997 | Kovach et al. | 271/145 |
| 5,879,003 | 3/1999 | Kovach et al. | 271/121 |
| 5,895,040 | 4/1999 | Oleksa et al. | 271/124 |
| 5,899,450 | 5/1999 | Gettelfinger et al. | 271/121 |
| 5,918,874 | 7/1999 | Armstrong et al. | 271/117 |
| 5,951,180 | 9/1999 | Kawaura | 400/629 |

*Primary Examiner*—John S. Hilten
*Assistant Examiner*—Dave A Ghatt
*Attorney, Agent, or Firm*—John A. Brady

[57] ABSTRACT

An image forming apparatus includes a print media supply with a pair of opposite sides and a bottom for supporting a plurality of print media sheets. A paper feed assembly defines a media path through which the print media sheets travel. A sheet picker assembly includes a sheet picker positioned adjacent to one of the sides of the print media supply. The sheet picker is configured to move a picked sheet in a pick direction substantially parallel to the bottom from the print media supply into the print media path. A separator dam is positioned between the print media supply and the paper feed assembly. The separator dam includes a wall positioned at a transverse angle relative to the bottom. The separator dam includes at least one resistive strip or abutments on the wall. The resistive strip or abutment is positioned adjacent the side which is opposite the one side. The resistive strip or abutment has a resistance to paper movement which is greater than the first coefficient of friction.

9 Claims, 3 Drawing Sheets

IMAGE FORMING APPARATUS WITH SHEET SEPARATOR

FIELD OF THE INVENTION

The present invention relates to an image forming apparatus, and, more particularly, to an image forming apparatus having a paper supply tray with a separator dam.

DESCRIPTION OF THE RELATED ART

An image forming apparatus, such as an electrophotographic printer, may include a supply tray which holds print media, such as paper. The media is held in the supply tray until a print job is requested, and is transported to an electrophotographic (EP) assembly within the printer where a latent image is transferred thereto. The media sheets are usually intended to be transported one by one from the supply tray and through a paper path to the EP assembly.

A supply tray of an image-forming apparatus can be variously configured. For example, one known configuration includes a supply tray having a bottom plate which is spring loaded from the bottom and biased in an upwardly direction. The spring loaded bottom plate biases a paper stack disposed within the supply tray in an upwardly direction against a corner buckler. A picker assembly, which may include a pick roller, engages the top of the top sheet of the paper stack and moves the top sheet into the paper path.

Another type of known supply tray includes a ramped surface or dam at an end thereof which is adjacent to the paper path in the printer. The paper in the supply tray is not biased in an upwardly direction, but rather merely lays on the bottom of the supply tray. A picker assembly includes a sheet picker which engages the top of the top sheet in the paper stack and moves the top sheet up the dam and into the paper path of the printer. The sheet picker may be in the form of, e.g., a picker arm or picker roller.

Paper supply trays and picker assemblies as described above are generally effective in separating a top sheet of paper from a stack of paper and feeding the separated sheet of paper into a paper feed path of a paper feed assembly. However, a printer including such a supply tray and sheet picker assembly may not effectively separate a top sheet of paper if the stack of paper becomes edge-welded or stuck together due to moisture. Edge-welds are typically formed during paper manufacturing or transport and are characterized by the fibers in adjacent paper sheets becoming interlocked together. paper supply tray.

What is needed in the art is an image forming apparatus with improved sheet picking from a paper supply tray.

SUMMARY OF THE INVENTION

The present invention provides an image forming apparatus with a sheet picker along one side of a separator dam and a paper retarding member along an opposite side of the separator dam, whereby the print medium is caused to buckle in a generally reverse direction.

The invention comprises, in one form thereof, an image forming apparatus having a print media supply with a pair of opposite sides and a bottom for supporting a plurality of print media sheets. A paper feed assembly defines a media path through which the print media sheets travel. A sheet picker assembly includes a sheet picker positioned adjacent to one of the sides of the print media supply. The sheet picker is configured to move a picked sheet in a pick direction substantially parallel to the bottom from the print media supply into the print media path. A separator dam is positioned between the print media supply and the paper feed assembly. The separator dam includes a wall positioned at a transverse angle relative to the bottom. The wall has a first coefficient of friction. The separator dam further includes at least one resistive strip on the wall. The resistive strip is positioned adjacent the side which is opposite the one side. The resistive strip has a second coefficient of friction which is higher than the first coefficient of friction.

An advantage of the present invention is that the reverse buckling of the print media sheets inhibits tears, nicks, and other physical damage to the print media sheets.

Another advantage is that by positioning the sheet picker assembly on a side of the supply tray opposite the resistive strip, the print media is caused to buckle in a direction up the separator dam, thereby minimizing skew.

Yet another advantage is that the reverse buckling of the print media is effected without the use of hard stops which impinge upon the edge of the print media, thereby minimizing jamming and improving reliability.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
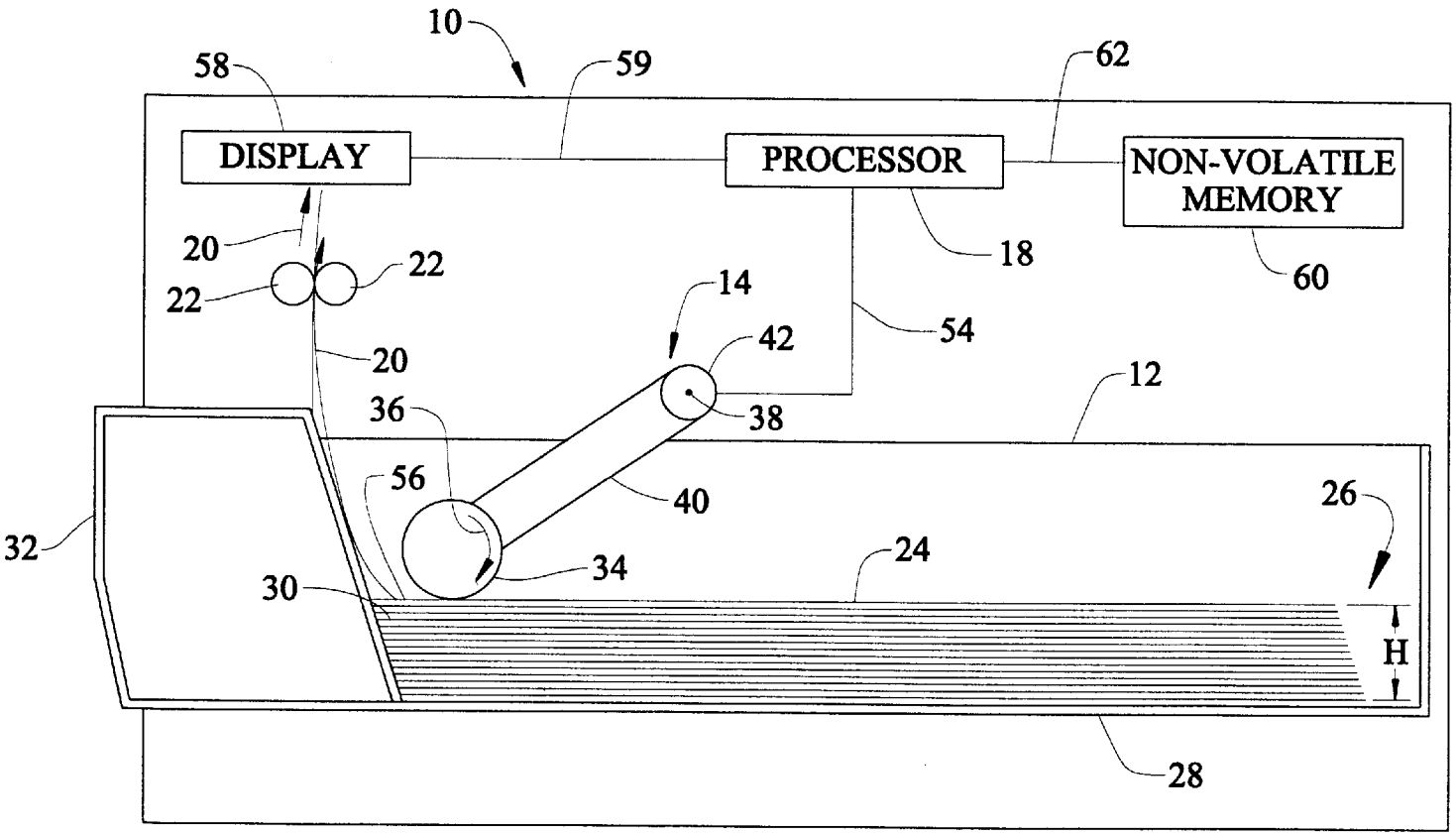
FIG. 1 is a schematical, side view of an embodiment of a printer of the present invention.

Referring now to the drawings, and particularly to FIG. 1, there is shown an embodiment of an image forming apparatus 10 of the present invention, which is in the form of an electrophotographic printer. Printer 10 includes a print media supply or supply tray 12, picker assembly 14 and processor 18. Printer 10 also defines a media path, or paper path, through which media sheets travel, as indicated generally by arrow 20. A paper feed assembly including a plurality of rollers, such as rollers 22, may be disposed within printer 10 along paper path 20 for guiding and/or feeding a sheet through paper path 20.

Supply tray 12 includes a plurality of media sheets or paper sheets 24 defining a media stack 26 which is disposed within supply tray 12. Media sheets 24 can be in the form of various types of print media, as is known. Media stack 26 rests directly on a bottom 28 of supply tray 12. It is thus apparent that a media sheet 24 is drawn from the top of media stack 26, which in turn diminishes in height. A ramped surface or separator dam 30 is disposed at an end of supply tray 12 between paper stack 26 and the paper feed assembly including rollers 22. In the embodiment shown, dam 30 is disposed adjacent to the end of supply tray 12 which defines a handle 32 allowing a user to insert or remove supply tray 12 from printer 10. Dam 30 is positioned at an angle α relative to bottom 28 (e.g., 69–70°) such that a media sheet 24 which is pushed there against by picker assembly 14 is deflected in an upward direction indicated by paper path 20.

Picker assembly 14 includes a movable picker 34 which rests on top of a top media sheet 24 of media stack 26. Picker 34, in the embodiment shown, is in the form of a pair of pick rollers which rotate as indicated by arrow 36 to move a media sheet 24 into paper path 20. More particularly, picker assembly 14 is pivotable about a pivot point 38 such that pick roller 34 is caused by gravitational force to rest against a top media sheet 24. A drive train housing 40 includes a plurality of gears, pulleys, belts or the like for transferring rotational power from a power source to pick roller 34. The power source may be in the form of a motor, such as a stepper motor 42, forming a part of picker assembly 14; or may be in the form of a separate motor (not shown) which is coupled to picker assembly 14 using a clutch or the like. Stepper motor 42 is connected to and controlled by processor 18 via conductor 54. Picker assembly 14 may also be in the form of a pick arm (not shown).

Figure 2:
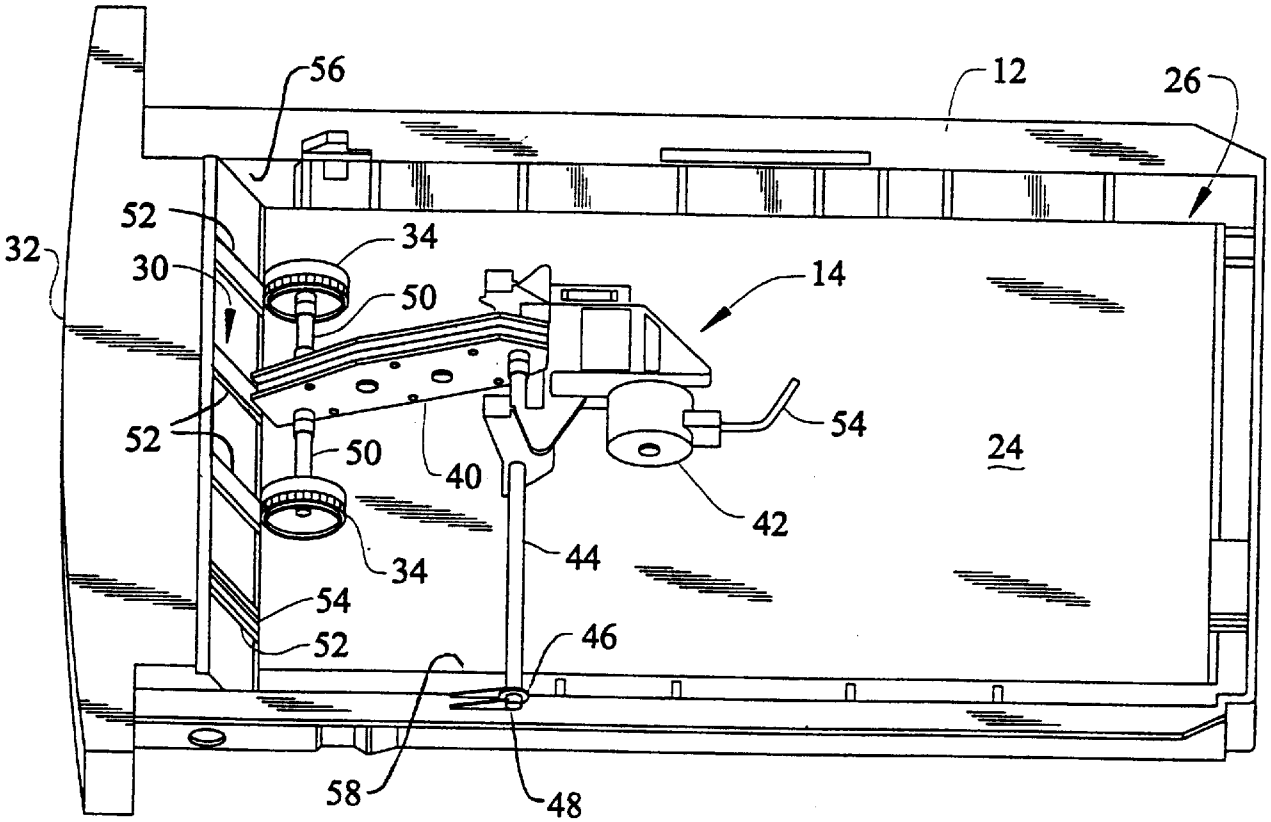
FIG. 2 is a perspective view of the supply tray and picker assembly shown in FIG. 1.

Referring now to FIG. 2, one embodiment of picker assembly 14 is shown in greater detail. Picker assembly 14 rotates about a longitudinal axis of a swing arm 44 having a cam 46 at a distal end thereof. The longitudinal axis of swing arm 44 defines pivot point 38 (FIG. 1). Cam 46 engages a projecting surface 48 of supply tray 12, and is operable upon insertion and removal of supply tray 12 from printer 10 to swing picker assembly 14 up and out of the way for removal of supply tray 12. Cam 46 is also engageable by projecting surface 48 of supply tray 12 to move pick rollers 34 against a top sheet media sheet 24 upon insertion of supply tray 12 into printer 10. Drive train housing 40 includes a plurality of gears (not shown) which interconnect stepper motor 42 with output shafts 50 driving pick rollers 34.

Processor 18 generally is of known construction and may include various required or optional hardware, such as a microprocessor, RAM memory, data buffer, etc. Processor 18 controls operation of stepper motor 42 and in turn controls movement of pick rollers 34. More particularly, processor 18 provides a signal over conductor 54 which is used to control operation of stepper motor 42. Processor 18 is connected via a single or multi-line conductor 59 to a display 58 for displaying a printer status. Moreover, display 58 can in fact be a display on a host computer in addition to or instead of being incorporated into printer 10 as shown in FIG. 1. Processor 18 may also be connected via a multi-line conductor 62 to a non-volatile memory 60, which preferably is in the form of a programmable non-volatile memory such as an EEPROM or flash memory. Those skilled in the art will recognize that processor 18 could include multiple processors which are in communication with one another.

According to an aspect of the present invention, separator dam 30 includes at least one resistive strip 54 which is attached to or carried thereby. More particularly, separator dam 30 includes a plurality of lands 52 which project toward paper stack 26 within paper supply tray 12. In the embodiment shown, separator dam 30 includes four lands 52 which are approximately 13 mm in width, 4 mm in depth and have a height which is the same as separator dam 30. At least one of the lands 52 of separator dam 30 includes a resistive strip 54 which is attached to or carried thereby. Each resistive strip 54 has a coefficient of friction which is higher than a coefficient of friction of lands 52. In the embodiment shown, each land 52 is comprised of a Teflon (TM) coated metal having a coefficient of friction of between about 0.2 and 0.3, and resistive strip 54 is comprised of a urethane mixture having a coefficient of friction of between about 1.0 and 1.2. Each resistive strip 54 is configured and dimensioned to have an appropriately shaped surface with a width which is sufficient to cause reverse buckling of a top paper sheet 24, as will be described in more detail hereinafter. In the embodiment shown, resistive strip 54 is attached to a land 52, and is about 1.5 mm in width, nominally about 0.4 mm in depth and has a height about the same as the attached land 52.

Figure 3:
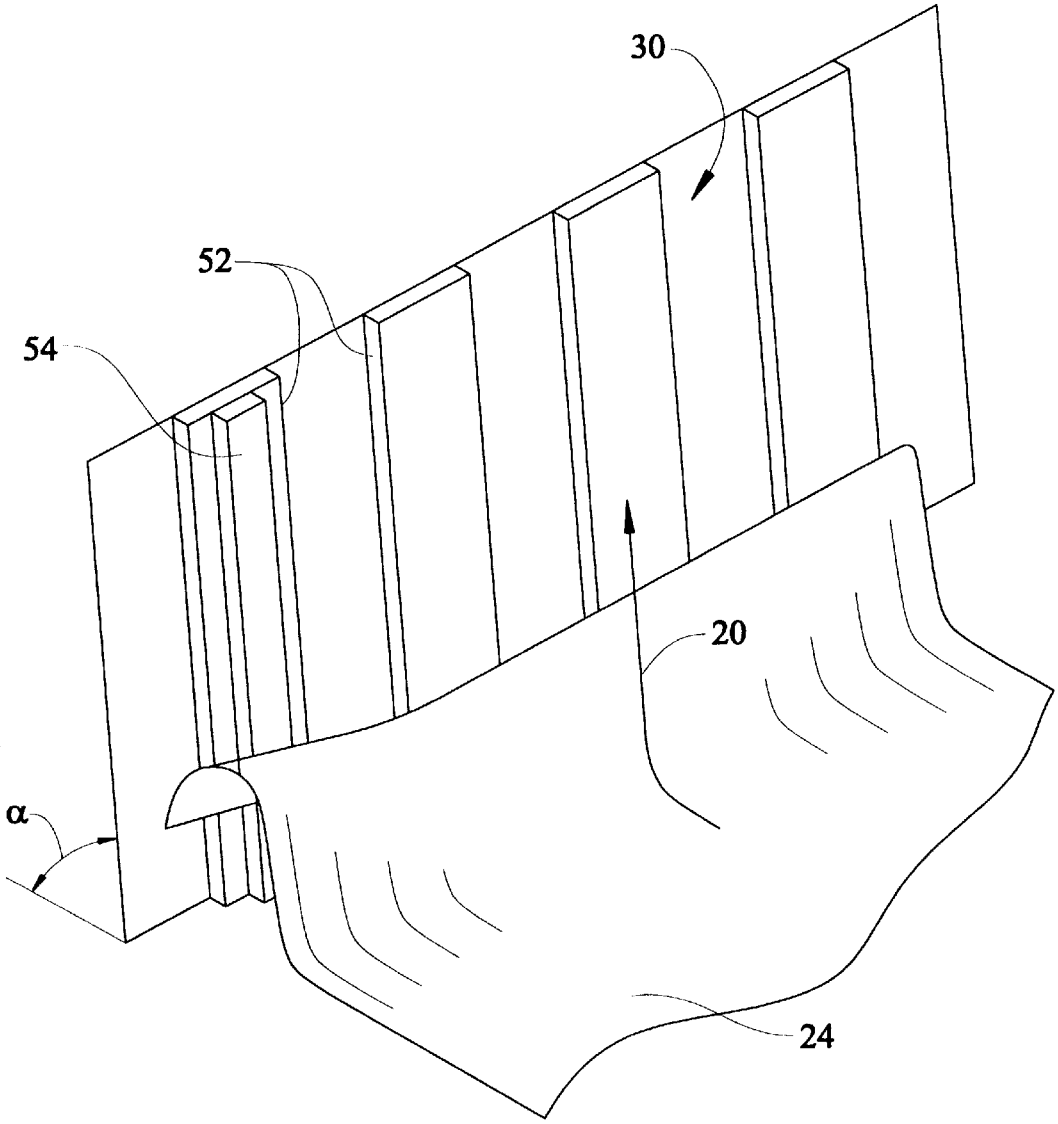
FIG. 3 is a perspective view illustrating reverse buckling of a paper sheet using the separator dam and resistive strip shown in FIG. 2.

Resistive strip 54 is positioned along separator darn 30 in an area outside the area which is contacted by or between pick rollers 34. In the embodiment shown, picker assembly 14 is positioned adjacent to a side 56 of supply tray 12. Since picker assembly 14 includes two pick rollers 34 which are spaced apart from each other, slightly more than half the width of a top paper sheet 24 from side 56 is directly affected by pick rollers 34. Pick rollers 34 cause the top paper sheet 24 to buckle in a single, upward direction as indicated by the right hand half of the paper sheet 24 shown in FIG. 3. An opposite side 58 of supply tray 12 is positioned a predetermined distance away from an adjacent feed roller 34 (i.e., the bottom most feed roller 34 shown in FIG. 2). Since the area of the top paper sheet 24 adjacent side 58 is to a greater extent unaffected by the buckling action caused by pick rollers 34, the effect of the resistive strip 54 on the leading edge of a top paper sheet 24 causes paper sheet 24 to buckle in two directions. The first direction is toward the feed direction of paper sheet 24 in the area of pick assembly 14. Additionally, paper sheet 24 buckles to direct the end engaging strip 54 in a direction generally opposite to a direction of paper feed path 20. By buckling at least a portion of paper sheet 24 away from side 56 in a reverse direction as shown the top paper sheet 24 is separated from feeding while, tears, nicks and other physical damage to paper sheet 24 are inhibited.

As a leading edge of paper sheet 24 travels past the upper most portion of resistive strip 54, paper sheet 24 straightens out so that the entire leading edge of paper sheet 24 feeds directly into paper feed path 20 within printer 10.

In the embodiment of the present invention described above, resistive strip 54 is attached to a land 52 using an adhesive backing. However, it is also possible for resistive strip 54 to be carried by and project from a slot formed within a land 52. The resistive strip may be configured to deflect away from the leading edge of paper sheet 24 when engaged thereby, or may be non-deflectable when engaged by the leading edge of paper sheet 24. For details of a resistive strip which projects from a slot within a land of a separator dam, reference is hereby made to U.S. Pat. No. 5,895,040, entitled "SHEET SEPARATOR" filed Jun. 20, 1997.

Moreover, in the embodiment of the present invention described above, picker assembly 14 is disposed along a side 56 of paper supply tray 12 such that a substantial portion of a leading edge of a paper sheet 24 is not directly affected by picker assembly 14. However, if the picker assembly only includes a single pick roller or pick arm, or if the distance between an adjacent pair of pick rollers is reduced, it may be possible to place the pick roller(s) or pick arm toward the center of the leading edge of a paper sheet 24 such that a substantial portion of the leading edge on either side of the picker assembly is unaffected by the pick roller(s) or pick arm. Configured as such, the center portion of the paper sheet 24 would undergo typical buckling in a single direction, while the outside edges of paper sheet 24 adjacent to each of sides 56 and 58 would undergo reverse buckling to separate the top sheet 24 while preventing tears, nicks and other physical damage to paper sheet 24. Additionally, the reverse buckling of paper sheet 24 along each of the sides of the paper supply tray would ensure effective separation of the top paper sheet 24 from the rest of the paper stack 26.

The foregoing functions very well. For reduced manufacturing cost and elimination of wear, an alternative to resistive strip 54 is one or more previously known paper retarding, dome-shaped abutments protruding from a land 52. The end of paper 24 engages one of the abutments at a time (the abutments being separated along the feed path) and buckles as described with respect to the resistive strip embodiment until the resilient force of the paper 24 increases from buckling to the amount that paper 24 moves over the abutment which it had encountered.

While this invention has been described as having a preferred design, the present invention can be farther modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An image forming apparatus, comprising:

print media supply having a pair of opposite sides and a bottom for supporting a plurality of print media sheets;

a paper feed assembly defining a media path through which the print media sheets travel;

a sheet picker assembly including a sheet picker positioned adjacent to one of said sides of said print media supply, said picker being configured to move a picked sheet in a pick direction substantially parallel to said bottom from said print media supply into the print media path; and a separator dam positioned between said print media supply and said paper feed assembly, said separator dam including a wall positioned at a transverse angle relative to said bottom, said wall having a first coefficient of friction, said separator dam further including at least one paper retarding member on said wall, said paper retarding member being positioned adjacent said side which is opposite said one side, said sheet picker assembly arranged opposite where said wall has said first coefficient of friction and including structure to space said sheet picker from said at least one paper retard member a distance to buckle a picked sheet, said sheet picker assembly buckling said picked sheet in a reverse direction at said paper retard member.

2. The image forming apparatus as in claim 1 in which said paper retarding member is at least one resistive strip having a second coefficient of friction which is higher than said first coefficient of friction.

3. The image forming apparatus of claim 2, wherein said wall has a coefficient of friction of between 0.2 and 0.3, and said resistive strip has a coefficient of friction of between 1.0 and 1.2.

4. The image forming apparatus of claim 2, wherein said wall is formed from a first material and said resistive strip is formed from a second material.

5. The image forming apparatus of claim 4, wherein said first material is a coated metal and said second material is a urethane mixture.

6. The image forming apparatus of claim 4, wherein said resistive strip is attached to said wall.

7. The image forming apparatus of claim 1, wherein said print media supply comprises a supply tray.

8. The image forming apparatus of claim 1, wherein said sheet picker comprises a pick arm.

9. An image forming apparatus, comprising:

a print media supply having a pair of opposite sides and a bottom for supporting a plurality of print media sheets;

a paper feed assembly defining a media path through which the print media sheets travel;

a sheet picker assembly including a sheet picker configured to move a picked sheet in a pick direction substantially parallel to said bottom from said print media supply into the print media path; and a separator dam positioned between said print media supply and said paper feed assembly, said separator dam including a wall positioned at a transverse angle relative to said bottom, said wall having a first coefficient of friction, said separator dam further including at least one resistive strip on said wall which is positioned away from said sheet picker, each said resistive strip having a second coefficient of friction which is higher than said first coefficient of friction, each said resistive strip being configured to buckle a picked sheet in a reverse direction, said sheet picker assembly arranged opposite where said wall has said first coefficient of friction and including structure to space said sheet picker from said at least one paper retard member a distance to buckle a picked sheet, said sheet picker assembly buckling said picked sheet in a reverse direction at said paper retard member.

* * * * *